US005699569A

United States Patent [19]

Schwarz-Zöhrer

[11] Patent Number: 5,699,569

[45] Date of Patent: Dec. 23, 1997

[54] COMBINED BED AND SEAT DEVICE FOR AN INFANT

[76] Inventor: Sabine Schwarz-Zöhrer, Pfarrgasse 61/14/1, 1232 Wien, Austria

[21] Appl. No.: 635,942

[22] PCT Filed: Oct. 27, 1994

[86] PCT No.: PCT/AT94/00159

§ 371 Date: Jun. 14, 1996

§ 102(e) Date: Jun. 14, 1996

[87] PCT Pub. No.: WO95/11607

PCT Pub. Date: May 4, 1995

[30] Foreign Application Priority Data

Oct. 27, 1993 [AT] Austria ..... 2158/93

[51] Int. Cl.[6] ..... A47D 11/00; A47C 27/10

[52] U.S. Cl. ..... 5/655; 5/93.2; 5/710; 5/945; 297/DIG. 3

[58] Field of Search ..... 5/655, 945, 655.3, 5/93.1, 94, 98.1, 99.1, 706, 710, 93.2; 297/DIG. 3

[56] References Cited

U.S. PATENT DOCUMENTS

| | | | |
|---|---|---|---|
| 3,513,489 | 5/1970 | Miller et al. | 5/945 |
| 3,761,975 | 10/1973 | Personnet | 5/655 |
| 4,583,253 | 4/1986 | Hall | 5/655 |
| 5,005,902 | 4/1991 | Farnworth et al. | 5/417 |

FOREIGN PATENT DOCUMENTS

| | | | |
|---|---|---|---|
| 0 350 236 | 1/1990 | European Pat. Off. . | |
| 2 588 737 | 4/1987 | France . | |
| 464908 | 11/1950 | United Kingdom . | |
| 646908 | 11/1950 | United Kingdom | 5/634 |
| 1344438 | 1/1974 | United Kingdom . | |

*Primary Examiner*—Alexander Grosz
*Attorney, Agent, or Firm*—Henry M. Feiereisen

[57] ABSTRACT

A combined bed and seat device for an infant is made of plastic material and is formed with various separately inflatable elements, namely a base (1) upon which the child sits or lies, a cushion (2) that surrounds the base (1) on three sides, an outer wall connected thereto and formed of wedge-shaped configuration in side view, and a second inflatable cushion (6) of approximately same circumference and connected to the other border of the outer wall (4). The cushion (6) forms the body that supports and stabilizes the bed upon the ground. In order to angle the base (1) into the seating position, the cushion (2) is clampable approximately in the middle of its length by means of an eyelet connection (5) against the second cushion (6). The inclination of the base (1) is adjustable by inflating the outer wall (4) to a lesser or greater degree. By turning the bed and seat device upside down a sleeping unit is formed, with the inflated outer wall (4) acting as wind screen or sun protection and with the base (1) being in lowermost horizontal position.

7 Claims, 4 Drawing Sheets

FIG. 5
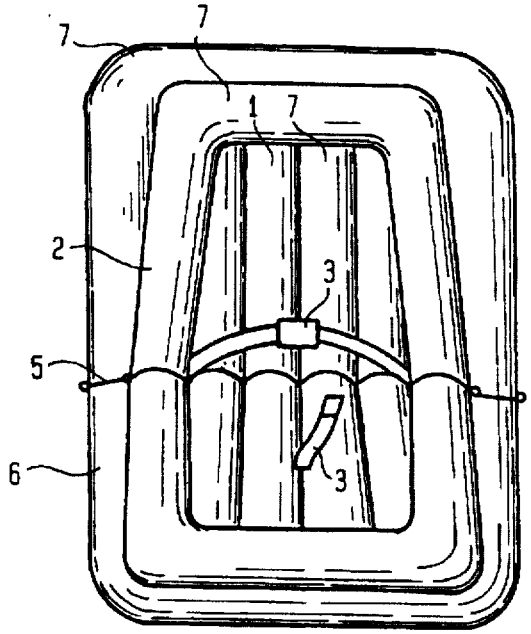
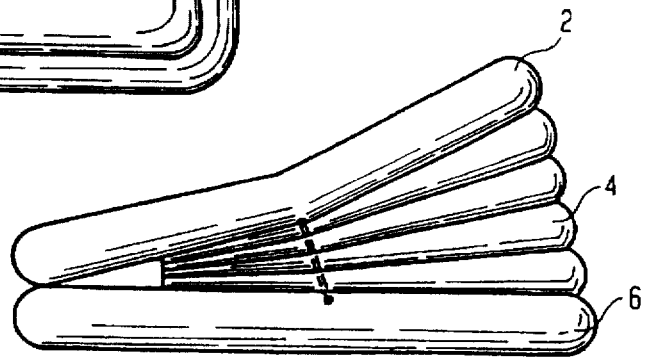
FIG. 6
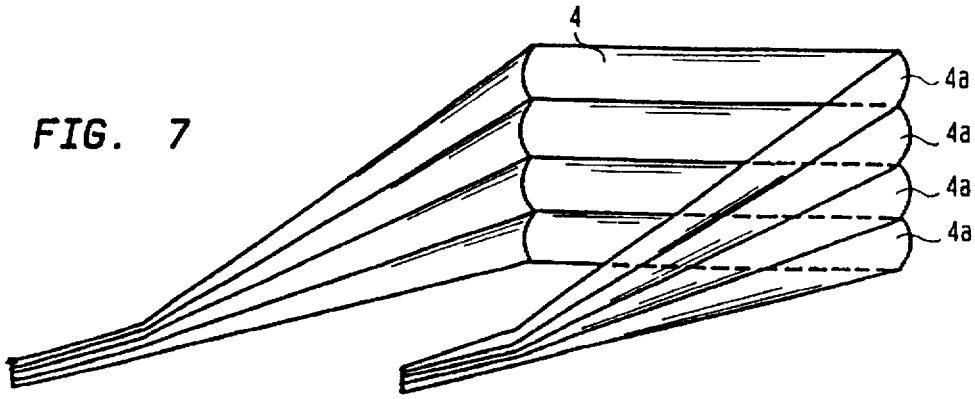
FIG. 7

COMBINED BED AND SEAT DEVICE FOR AN INFANT

BACKGROUND OF THE INVENTION

The present invention refers to a combined bed and seat device.

British Pat. No. 1,343,281 discloses a bed which includes a support base that forms a recumbent area and is surrounded by an inflatable cushion. An outer wall which is of wedge-shaped configuration in side view and exhibits individually inflatable vertical compartments provides the height for an inflatable head and neck support and the arm rests, respectively. The head and neck support and the arm rests are formed on three sides of the bed by inflatable cushions. This conventional bed is usable only in one position and cannot be adjusted for accommodating an infant in seated or recumbent positions, or in two positions turned by 180°.

U.S. Pat. No. 3,761,975 discloses a mattress for children with inflatable annular cushion, whereby the support surface cannot be adjusted, so that the child can only lie thereon.

British Pat. No. 646,908 discloses a pneumatic mattress with a wedge-shaped, cushioned backrest having an upwardly pointed wedged flank that forms a support surface. This is unsuitable for an infant because a child may slide off sideways and fall out.

SUMMARY OF THE INVENTION

In contrast thereto, it is an object of the invention to create a bed of the above-stated type for infants, which is can be utilized more versatile and can be adjusted in more ways than conventional devices.

This object is attained according to the invention by providing a support base which forms a seat area or recumbent area for the child and is enclosed by a circumferential, inflatable first cushion, with the base being connected on three sides with an inflatable outer wall member of wedge-shaped configuration in side view, whereby the other border of the wall member is connected to a second inflatable cushion wherein the second cushion is approximately of same circumference as the first cushion that surrounds the support and is intended for use as a body to support the bed and seat device, and by clamping the cushion that surrounds the base by means of an eyelet connection approximately in the middle of its length against the second cushion for angling the base into a seating position. The eyelet connection effects the configuration of the seating area (in seating position), and is loosened for the recumbent position. The cushion surrounding the base protects the recumbent or sitting infant in order to prevent the child from falling out sideways. The side wall cushion provides stability for the child's bed.

Through the configuration according to the invention, both cushions surround the circumference of the base and thus both are equally suitable to serve as footing of the bed so that the entire bed can be turned by 180° to effect a recumbent area, with the outer wall acting as wind screen or sun protection.

Preferably, it is provided to form the inflatable outer wall with several superimposed chambers which extend in direction of the cushions and preferably are connected with one another.

Through individual inflation, the required inclination of the seating area and recumbent area can be regulated, with the chambers being arranged horizontally in direction of the cushions and connected to one another so that through appropriate inflation the desired height is created.

According to a preferred embodiment, it is further provided to secure in a manner known per se safety belts to the base. The safety belt as known per se from the British Pat. No. 1,344,438 for use with an inflatable child bed, prevents the child from standing up (two-belt system). According to the configuration of the invention, the belt prevents the child from sliding off sideways or, when occupying a seated position, from sliding off forwardly (three-belt system).

BRIEF DESCRIPTION OF THE DRAWINGS

An exemplified embodiment of the invention will now be described in more detail with reference to the drawings, in which:

FIG. 5 is a top view of the fully inflated infant bed and seat device of FIG. 1;

FIG. 6 a further side view of the infant bed and seat device of FIG. 1;

FIG. 7 a detailed, perspective illustration of an outer wall member with the air chambers;

DETAILED DESCRIPTION OF A PREFERRED EMBODIMENT

Figure 1:
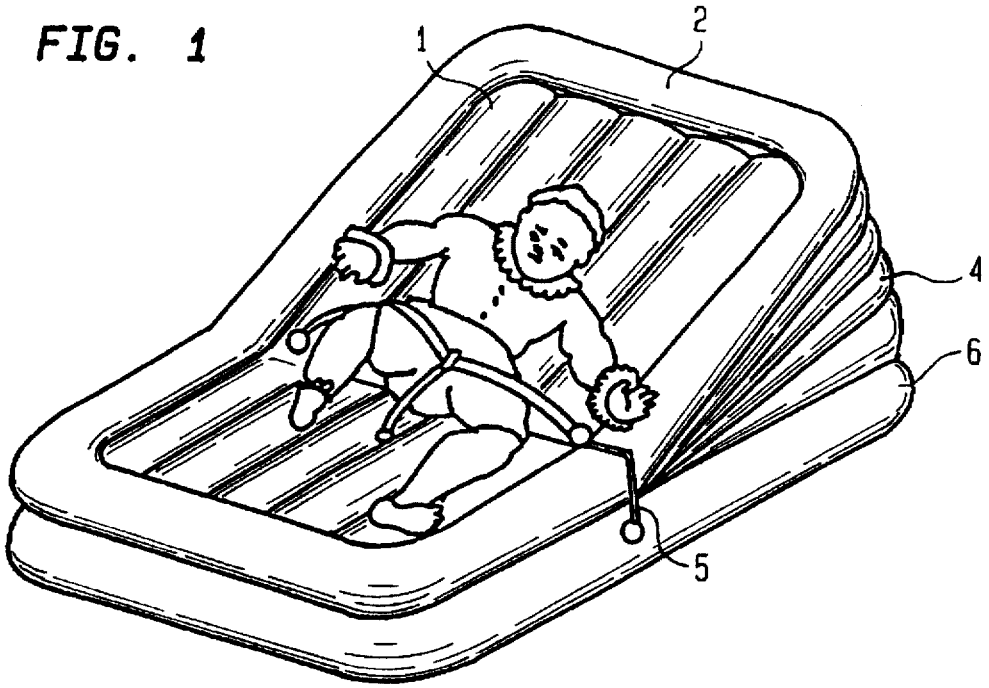
FIG. 1 shows an overall perspective illustration of a combined infant bed and seat device according to the present invention in a first operative position for use as a seat for an infant.
Figure 2:
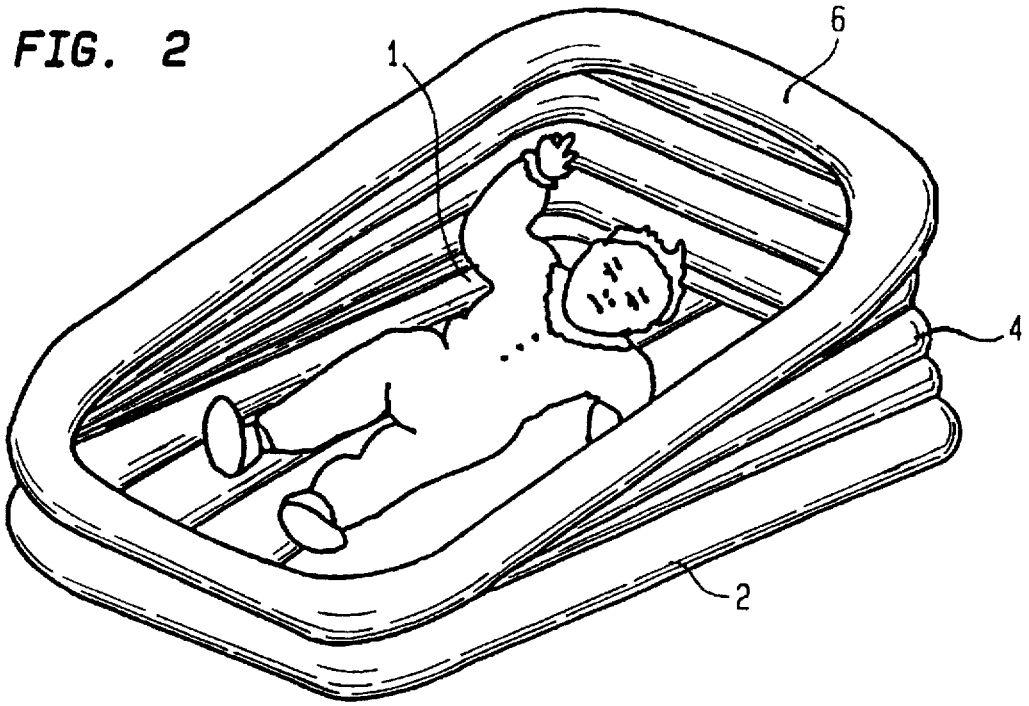
FIG. 2 shows an overall perspective illustration of the infant bed and seat device of FIG. 1 in a second operative position for use as a bed for the infant.
Figure 3:
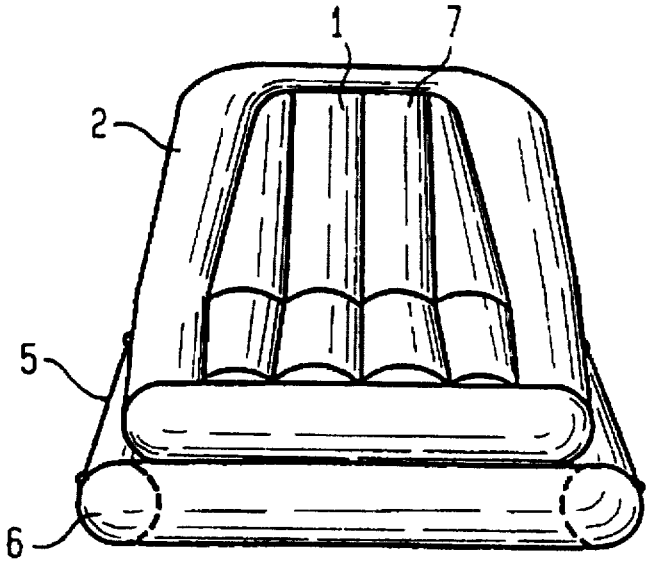
FIG. 3 is a top, front perspective view.
Figure 4:
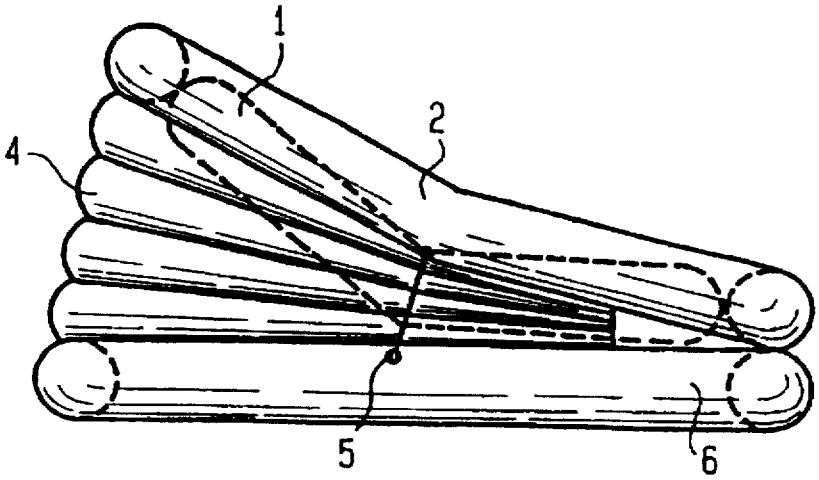
FIG. 4 is a side view of the infant bed and seat device of FIG. 1, showing in broken line a modified position through suitable attachment of an eyelet connection.

The infant bed and seat device according to the invention is inflatable and usable as seat or traveling bed, and is made of plastic material with four different elements which are separately inflatable, namely two cushions 2, 6, an outer wall member 4 and a support base 1 that forms a seating area or recumbent area.

The advantage thereof is the ability to take the (deflated) bed and seat device everywhere, without requiring much space, and to inflate and place the bed on the spot.

The base 1 that serves as seating area or recumbent area is surrounded by the inflatable cushion 2 and connected on three sides with the inflatable outer wall 4 which is of wedge-shaped configuration in side view. The other border of the outer wall 4 is connected with the second, inflatable cushion 6 which is approximately of same circumference. The valves for inflating the individual elements are designated by reference numeral 7.

In the position of the bed and seat device shown in FIGS. 1 and 3 to 6, the cushion 6 forms the body that supports and stabilizes the bed and seat device upon the ground. The inclination of the base 1 is adjustable by inflating the outer wall 4 to a lesser or greater degree. The cushion 2 represents the upwardly directed (terminal) portion and serves for protecting the infant such that the child is prevented from falling out sideways. Moreover, a safety belt 3 (three-belt system) is secured to the support 1 for preventing the child from sliding off sideways or from sliding off forwards when occupying a seated position. In order to slant the base 1 into the seating position, the cushion 2 is clampable against the second cushion approximately in the middle of its length by an eyelet connection generally designated by reference numeral 5 and provided one each longitudinal side of the infant bed and seat device, as shown in FIG. 5 against the second cushion 6. Each eyelet connection 5 is of conventional configuration and, as shown in FIG. 1, includes an eyelet 5*a* secured to the cushion 6 and an eyelet 5*b* secured to the cushion 2, with both eyelets 5*a*, 5*b* being so linked by an adjustable strap 5*c* that the cushions 2 and 6 are squeezed toward one another, to thereby allow an angled disposition of the rearward or back section of the cushion 2 relative to a forward section thereof.

FIG. 7 shows a separate illustration of the outer wall 4, with the air chambers 4*a* extending in direction of the cushions 2, 6 and preferably connected with each other. The air chambers of the outer wall 4 may also extend vertically without changing the gist of the invention. The various degrees of inclination of the recumbent position are effected by inflating the outer wall 4 to a lesser or greater degree.

Figure 8:
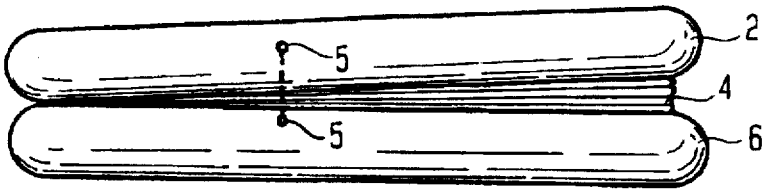
FIGS. 8 and 9 show side and top views of the infant bed and seat device according to the invention, with deflated outer wall (in sleeping or resting positions)
Figure 9:
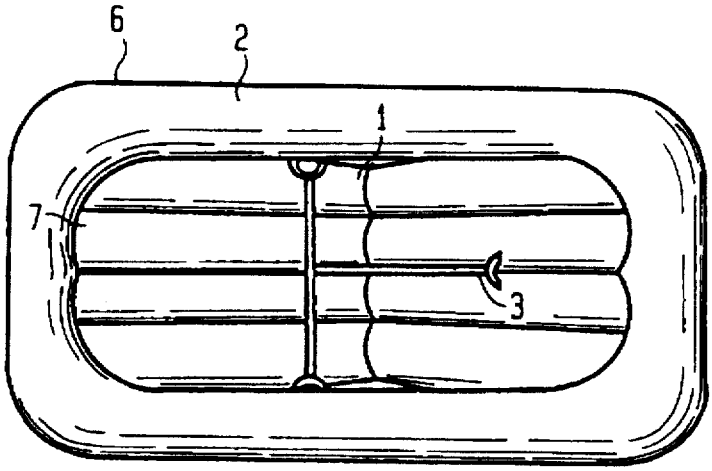

If required (sleeping position of the child), the eyelet connections 5 can be loosened, and air can be let out from the outer wall 4 to reduce the volume of the outer wall 4. The cushion 2 then sinks onto the cushion 6, and the infant occupies a horizontal resting position (see FIGS. 8 and 9).

Figure 10:
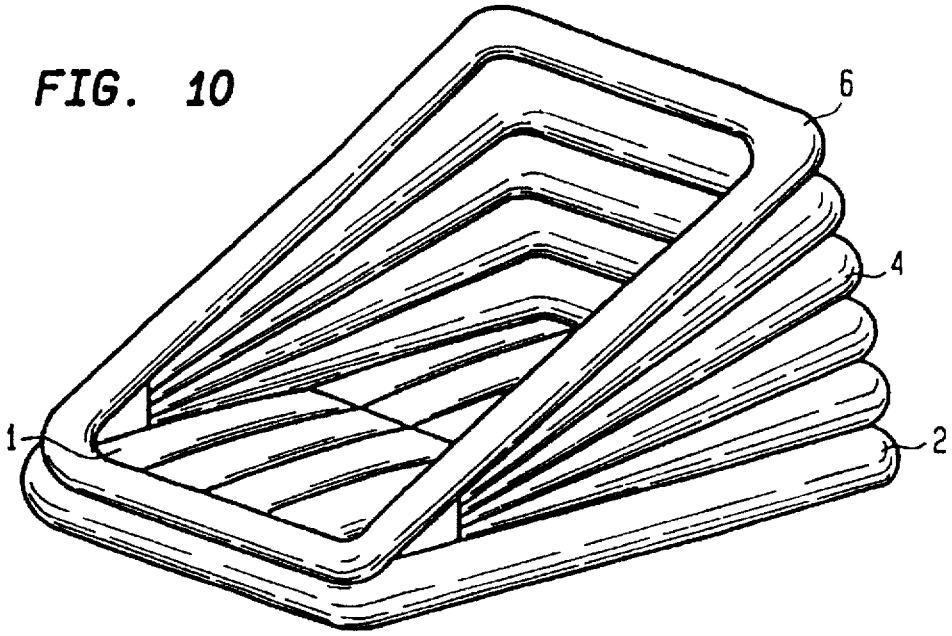
FIG. 10 is a perspective view of the infant bed and seat device in the second operative position in which the bed is in inverted disposition and the outer wall member is fully inflated.

When turning the bed and seat device upside down, it is changed to a sleeping bed with wind screen. The base 1 (seating area and recumbent area) and the cushion 2 occupy their lowermost horizontal position. The inflated outer wall 4 then acts as wind protection and sun protection (see FIG. 10).

What is claimed is:

1. A bed for an infant, comprising:

a base (1) for supporting an infant;

a first inflatable cushion (2) secured to and surrounding the base (1);

a second inflatable cushion (6) having a forward section which is secured to a forward section of the first inflatable cushion (2), said second cushion defining a circumference which substantially equals a circumference of the first cushion;

an inflatable bellows-type wall member (4) of wedge-shaped configuration disposed between the first and second cushions and secured to a rearward section of the first and second cushions; and a fastening means (5) for so detachably connecting the first cushion to the second cushion as to permit an adjustment of the support between a first operative position in which the base (1) is angled relative to the second cushion (6) and a second operative position in which the base (1) is in a horizontal disposition.

2. The bed of claim 1 wherein the wall member (4) includes several superimposed air-containing chambers (4*a*) extending between the first and second cushions (2, 6).

3. The bed of claim 2 wherein the chambers are interconnected with one another.

4. The bed of claim 1, and further comprising safety belts (3) secured to the base (1).

5. A combined bed and seat device for an infant, comprising a body member including a base for supporting an infant; a first inflatable cushion secured to and surrounding the base, a second inflatable cushion having a forward section secured to a forward section of the first inflatable cushion, and an inflatable wall member wedged between a rearward section of the first and second cushions, said body member being positionable in a first operative position in which the base is of horizontal orientation for providing a bed for the infant and in a second operative position in which the body member is placed upside down to display an inclined orientation of the base for providing a seat for the infant, said combined bed and seat device further comprising a fastening means for so detachably connecting the first cushion to the second cushion as to permit an angled position of a rearward section of the base relative to a forward section of the base when the body member occupies the first operative position.

6. The combined bed and seat device of claim 5 wherein the second cushion extends at an inclination relative to the first cushion when the body member occupies the first operative position, with the wall member forming a protection for the infant.

7. The combined bed and seat device of claim 5 wherein the wall member includes several superimposed chambers extending between the first and second cushions for allowing adjustment of the degree of inclination of the base in the second operative position of the body member.

* * * * *